US009516948B2

(12) United States Patent
Migli

(10) Patent No.: US 9,516,948 B2
(45) Date of Patent: Dec. 13, 2016

(54) TOUCH-LATCH DEVICE FOR OPENING AND HOLDING A FURNITURE OPENING COMPONENT IN A CLOSED POSITION

(75) Inventor: Carlo Migli, Lecco (IT)

(73) Assignee: Titus d.o.o. Dekani, Dekani (SI)

( * ) Notice: Subject to any disclaimer, the term of this patent is extended or adjusted under 35 U.S.C. 154(b) by 123 days.

(21) Appl. No.: 14/005,807

(22) PCT Filed: Mar. 20, 2012

(86) PCT No.: PCT/SI2012/000017

§ 371 (c)(1),
(2), (4) Date: Sep. 17, 2013

(87) PCT Pub. No.: WO2012/128730

PCT Pub. Date: Sep. 27, 2012

(65) Prior Publication Data

US 2014/0001938 A1 Jan. 2, 2014

(30) Foreign Application Priority Data

Mar. 22, 2011 (SI) ..... 201100102

(51) Int. Cl.
*E05C 17/56* (2006.01)
*E05C 19/16* (2006.01)
(Continued)

(52) U.S. Cl.
CPC ..... *A47B 88/0477* (2013.01); *E05C 19/022* (2013.01); *E05C 19/165* (2013.01)

(58) Field of Classification Search
CPC .... Y10S 292/04; Y10S 292/37; Y10T 292/11; A47B 88/0477; E05C 19/022; E05C 19/165
(Continued)

(56) References Cited

U.S. PATENT DOCUMENTS 2,801,870 A * 8/1957 Davey ..... 292/251.5
2,990,210 A * 6/1961 Fremstad ..... 292/251.5
(Continued)

FOREIGN PATENT DOCUMENTS

DE 1784817 A1 1/1972
EP 1584779 A2 * 10/2005
(Continued)

OTHER PUBLICATIONS

International Search Report; PCT/SI2012/000017; Oct. 5, 2012.

*Primary Examiner* — Vishal Patel
*Assistant Examiner* — Faria Ahmad
(74) *Attorney, Agent, or Firm* — Studebaker & Brackett PC

(57) ABSTRACT

A touch-latch device used in furniture especially for initial opening of an opening furniture component, comprising a housing with an axially arranged groove, in which a push element is slidingly arranged, said element being actuated by a helical spring and controllable by a dual-position guide mechanism comprising a cam groove guide and an S-pin, wherein the device comprises a push element controlled by two dual-position guide mechanisms, wherein each cam groove guide of a dual-position guide mechanism is arranged on a lateral side of the push element and the S-pin is pivoted in the lateral wall of the groove of the housing, and that the push element is provided at its free end with a regulation plug arranged by means of a bolted joint, said plug being displaceable in axial direction, wherein the axial displacement of the regulation plug is limited by an arrester arranged therein.

10 Claims, 2 Drawing Sheets

Figure 1:
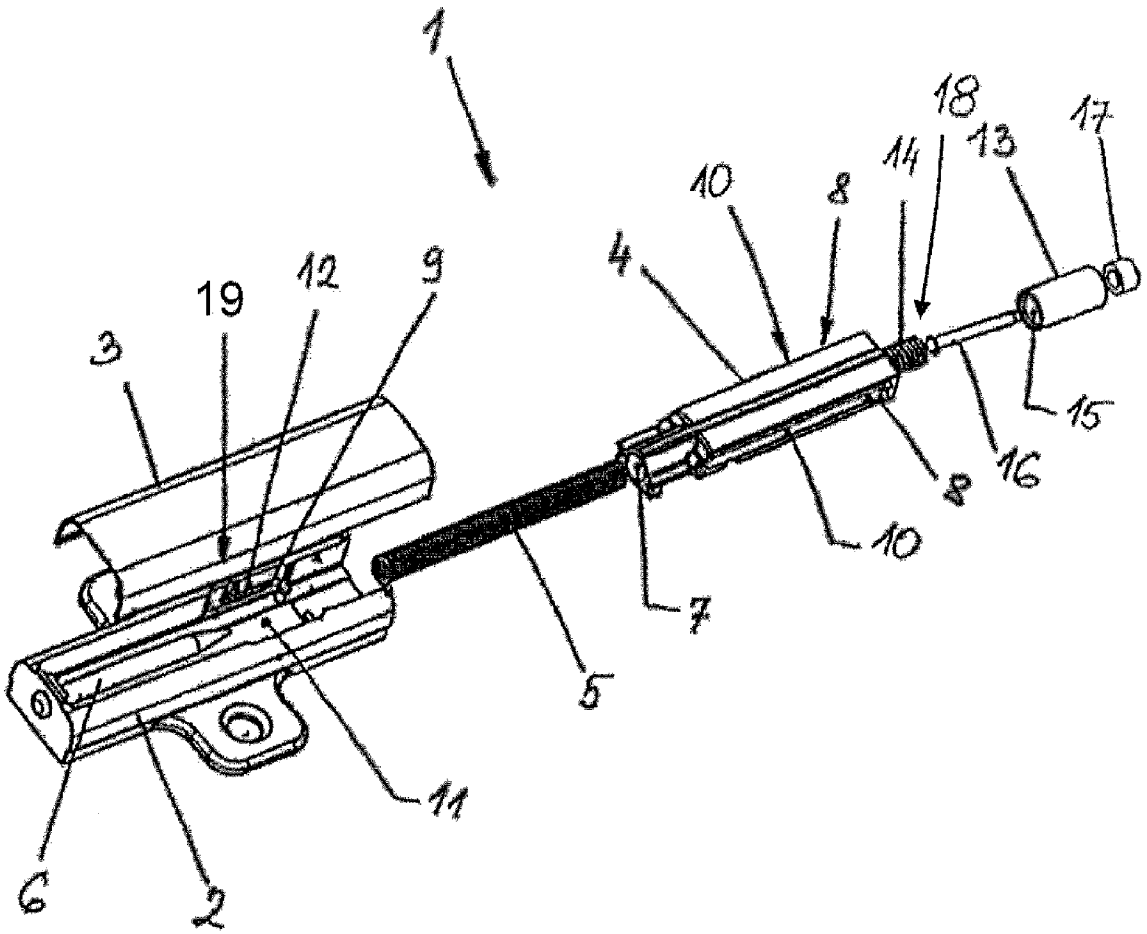

(51) Int. Cl.

| | |
|---|---|
| ***A47B 88/04*** | (2006.01) |
| ***E05C 19/02*** | (2006.01) |
| *E05B 63/20* | (2006.01) |
| *E05B 9/00* | (2006.01) |

(58) Field of Classification Search
USPC ..... 292/251.5, 332, 333, 334, 335, 337,292/DIG. 4; 16/84, 85
See application file for complete search history.

(56) References Cited

U.S. PATENT DOCUMENTS

| | | | | |
|---|---|---|---|---|
| 3,376,088 | A * | 4/1968 | Bol | A47B 88/0477 292/353 |
| 3,492,037 | A * | 1/1970 | Hutchinson | 292/251.5 |
| 3,600,025 | A * | 8/1971 | Brainard | 292/251.5 |
| 4,227,726 | A * | 10/1980 | Sorimachi | 292/251.5 |
| 4,249,761 | A * | 2/1981 | Nishimura | 292/251.5 |
| 4,270,781 | A * | 6/1981 | Nishimura | 292/251.5 |
| 4,660,871 | A * | 4/1987 | Arakawa et al. | 292/81 |
| 4,702,506 | A * | 10/1987 | Iimura | 292/251.5 |
| 4,895,404 | A * | 1/1990 | Toledano | 292/337 |
| 4,974,884 | A * | 12/1990 | Dietrich | 292/173 |
| 5,090,751 | A * | 2/1992 | Kobayashi | 292/71 |
| 5,211,432 | A * | 5/1993 | Lin | 292/169 |
| 5,342,101 | A * | 8/1994 | Shih | 292/165 |
| 5,489,128 | A * | 2/1996 | Florian | 292/1.5 |
| 5,709,421 | A * | 1/1998 | Gillham | 292/251.5 |
| 6,588,809 | B1 * | 7/2003 | Derman | 292/129 |
| 6,588,811 | B1 * | 7/2003 | Ferguson | 292/251.5 |
| 6,630,877 | B2 * | 10/2003 | Manthey | 335/205 |
| 7,273,240 | B2 * | 9/2007 | Migli | A47B 88/0477 292/251.5 |
| 7,657,970 | B2 * | 2/2010 | Artsiely | 16/85 |
| 7,793,995 | B2 * | 9/2010 | King et al. | 292/332 |
| 7,937,807 | B2 * | 5/2011 | Bereznai | 16/82 |
| 8,172,345 | B2 * | 5/2012 | Liang et al. | 312/333 |
| 8,376,420 | B2 * | 2/2013 | Peterlunger | 292/251.5 |
| 2004/0075281 | A1 | 4/2004 | Ueki | |
| 2005/0268432 | A1 * | 12/2005 | Migli | 16/258 |
| 2007/0245518 | A1 * | 10/2007 | Blair | 16/85 |
| 2007/0271732 | A1 * | 11/2007 | Bantle et al. | 16/84 |
| 2008/0023967 | A1 * | 1/2008 | King et al. | 292/64 |
| 2008/0203738 | A1 | 8/2008 | Peterlunger | |
| 2008/0295283 | A1 * | 12/2008 | Tice | 16/84 |
| 2009/0119873 | A1 * | 5/2009 | Bassi | 16/84 |
| 2009/0307869 | A1 * | 12/2009 | Salice | 16/85 |
| 2011/0094056 | A1 * | 4/2011 | Lautenschlager | 16/84 |
| 2015/0026923 | A1 * | 1/2015 | Nakasone | 16/85 |

FOREIGN PATENT DOCUMENTS

| | | | |
|---|---|---|---|
| EP | 1921238 | A1 | 5/2008 |
| ES | 2315055 | A1 | 3/2009 |
| WO | WO 03027510 | A2 * | 4/2003 |
| WO | 2007/101287 | A2 | 9/2007 |

* cited by examiner

TOUCH-LATCH DEVICE FOR OPENING AND HOLDING A FURNITURE OPENING COMPONENT IN A CLOSED POSITION

SUBJECT OF INVENTION

The subject of the invention is a touch-latch device used in furniture, especially for initial opening of an opening furniture component, such as drawers and doors without handles and also for holding such component in a closed position.

Technical Problem

The technical problem solved by the present invention is how to design such touch-latch device that would enable reliable functioning even in case of huge loads, like huge, full drawers or huge and heavy door, wherein it could be mounted into a minimal available space, such as a gap between a drawer wall and a carcass wall. The device should further allow regulation of the distance of a furniture component from its closed position. A touch-latch device so designed will also meet safety criteria, as it will not be dismantable and will thus not present a danger for small children in terms of swallowing and suffocating.

PRIOR ART

Numerous devices for opening drawers or doors without a handle are known. They function on the principle of a dual-position guide mechanism with an S shaped pin. One of such devices is disclosed in patent application EP 1921238 (Migli). The push-pull device has a substantially cylindrical housing, in which a dual-position guide mechanism with an S shaped pin in arranged. With its main leg said dual-position guide mechanism is approximately coaxial with the device in each stable position. In a closed position the biased helical spring pushes a thrust pin out of the device, thus displacing a drawer or a door from a closed position so that the drawer/door can be held and opened. The device or its housing must have a sufficient diameter, so that the S-pin—whose web is parallel with the main axis of the device and both legs extend in opposite radial directions—has enough space to move within the dual-position guide mechanism and the cylindrical housing of the device. If this requirement is to be met, the device should have a relatively large diameter, which raises a problem of device's arrangement into a narrow gap available in the drawer. In order to meet the requirement for as small dimension as possible, the S-pin dimension needs to be adjusted, which consequently means that the pin is able to carry less load and a device of this type can therefore not be used for opening drawers with huge masses. A further disadvantage of said device is that the distance—opening of a furniture component once the device has been fixed to the furniture—cannot be regulated any more. The device disclosed in ES 2315055 (Calvo, Angel) has a dual thrust pin, wherein both parts are mutually linked via screw, which allows setting of the thrust pin's length and thus the size of the distance of a furniture component from its closed position. A disadvantage of such solution is that both parts are dismountable, which represents a potential danger for small children who could swallow them and consequently suffocate.

Solution to the Technical Problem

The described technical problem is solved by a touch-latch device of the invention comprising a housing, inside of which a groove is arranged in the axis of the device. Within the groove a push element is slidingly arranged, which is actuated by a helical spring and controlled by a dual-position guide mechanism comprising a cam groove guide and an S-pin. The device is characterized by comprising a push element controlled by more than one, preferably two dual-position guide mechanisms, wherein each cam groove guide of the dual-position guide mechanism is arranged on a lateral side of the push element and each S-pin is pivoted in a lateral wall of the housing of the device, and that the push element is provided at its free end with a regulation plug, which is arranged thereon by means of a bolted joint and displaceable in axial direction, wherein the axial movement of the regulation plug is limited by an internal arrester.

To open heavy drawers or doors a sufficient push force is needed, which can be achieved by an adequate selection of a spring. Said force also acts on the S-pin. As the device of the invention comprises two mutually parallel distanced S-pins acting considerably in axial direction of the touch-latch device, each S-pin is loaded with half of the force. Consequently, each S-pin can accordingly be downsized and can carry twice the load by preserving equal dimensions, respectively. It can thus open large, heavy furniture components. The S-pins are arranged within the device housing in a way that the webs and the rectangular legs of both S-pins perpendicular thereto lie in the same plane that coincides with the axial plane of the device in idle mode. The height of the entire device is herewith reduced to the minimum height dictated by the main components.

Such device can be mounted to a relatively small space, such as a gap between a drawer and a wall of a chest of drawers and is simultaneously capable of opening furniture components of more considerable masses.

A regulation plug being actually an axial extension of the push element enables a regulation of size of initial opening of a furniture component via bolted joint or abolishes the errors caused in mounting. The internal arresting element prevents the regulation plug from complete unscrewing.

The invention will be explained in more detail in the continuation by way of an embodiment and the enclosed drawings, representing in:

FIG. 1 device of the invention in explosion view

Figure 2:
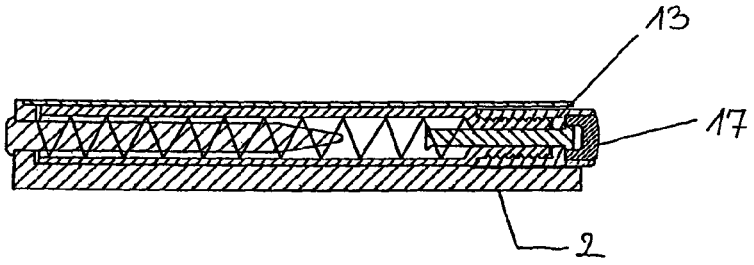

FIG. 2 cross-section of the device in a closed position

Figure 3:
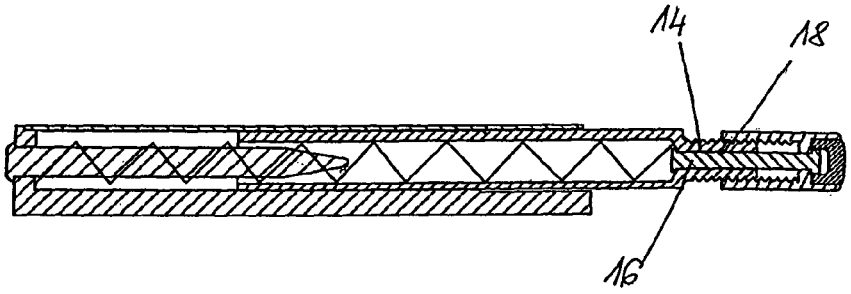

FIG. 3 cross-section of the device in an opened position

A touch-latch device 1 comprises a support housing 2, inside of which a groove 11 is arranged within an axis of the device. A push element 4 is slidingly arranged in the groove 11, said element 4 pushing a furniture opening component from a closed position into a partially opened position that allows a person to grip and finally open the component. The push element 4 is actuated by a pressure bias helical spring 5, being guided in an axial hole 7 of the push element 4 and with a guide 6 within the groove 11. On each of its lateral surface 10 the push element 4 is provided with a cam groove guide 8, into which each S-pin 9 projects and they jointly form a dual-position guide mechanism of a known type that controls the push element 4 and allow it to be hold in a position that determines the closed or opened situation of a furniture component.

Each S-pin 9 is arranged within a recess 12 of a lateral wall of the groove 11, wherein one leg of the S-pin 9 is pivoted in a corresponding hole 19 in the lateral wall of the groove 11, whereas another leg of the S-pin 9 projects into the interior of the groove 11 of the housing 2 and extends into the cam groove guide 8 of the push element 4. The S-plugs 9 are arranged in the lateral wall of the groove 11 in a way that the webs and the legs of both S-pins 9 lying perpendicularly thereto lie in a common plane that coincides with the axial plane of the device when in idle mode. The S-plug 9 is actually stationary in the device, it only performs a swinging movement, whereas the push element 4 performs a sliding movement.

At the free end of the push element 4 an axially displaceable regulation plug 13 is arranged by means of a bolted joint threaded plug 14/threaded hole 15. The threaded extension 14 has a through axial hole 18. Complete unwinding of the regulation plug 13 and thus its detachment from the push element 4 is prevented by an arrester 16 arranged in the interior of the regulation plug 13 and the axial hole 18 of the threaded extension 14 of the push element 4. Said arrester in the embodiment is a double-sided riveted bolt 16 of a predetermined length, which prevents the regulation plug 13 from getting detached and simultaneously sufficiently covers the regulation plug 13 of the threaded extension 14 in order to prevent damages of the device 1.

The free end of the regulation plug 13, with which the touch-latch device abuts on the furniture component, can optionally be provided with additional elements 17, such as a rubber plug for noise absorption upon impact of the regulation plug, a magnet plug, which contributes to a better closing of the furniture component in a closed position and prevents the furniture component from opening more than allowed by the touch-latch device.

The housing 2 is covered by a cover 3 preventing a possible detachment of an individual component from the device. The touch-latch device is fastened to a background by means of fastening elements of known types, such as differently shaped flanges, fit-on plugs or by insertion into a dedicated housing.

The touch-latch device is optionally manufactured from a metallic or plastic material.

The invention claimed is:

1. A touch-latch device used in furniture especially for initial opening of an opening furniture component, such as drawers or doors, without handles, comprising a housing with an axially arranged groove having lateral walls, in which groove a push element is slidingly arranged and actuated by a helical spring, said push element having two mutually parallel lateral surfaces and being controlled by two dual-position guide mechanisms, wherein each of the two dual-position guide mechanisms is disposed on one lateral surface of the push element and including a cam groove guide and an S-pin, wherein each of the cam groove guides is arranged on one lateral side of the push element, and each of the S-pins is pivotally arranged within a recess of the lateral wall of the groove of the housing, wherein one leg of the S-pin is in a hole in said recess and the second leg of the S-pin extends into the interior of the groove of the housing and into the cam groove guide of the push element, and the push element being provided at a free end with a regulation plug arranged by a bolted joint, said plug being displaceable in an axial direction, wherein the axial displacement of the regulation plug is limited by an arrester arranged therein.

2. Touch-latch device according to claim 1, wherein the arrester is a double-sided riveted bolt of a predetermined length arranged in a through hole of a threaded extension and the regulation plug.

3. Touch-latch device according to claim 1, wherein each S-pin is arranged within the hole in a way that the legs of both S-pins perpendicular thereto lie in a same plane that coincides with the axial plane of the device in an idle mode.

4. Touch-latch device according to claim 1, wherein an additional element is arranged at a free end of the regulation plug, the additional element is a rubber plug to absorb noise upon impact.

5. Touch-latch device according to claim 1, wherein an additional element is arranged at a free end of the regulation plug, the additional element is a magnet plug to prevent the furniture component from moving more than allowed by the touch-latch device.

6. A touch-latch device used in furniture especially for initial opening of an opening furniture component, such as drawers or doors, without handles, comprising a housing with an axially arranged groove having lateral walls, in which groove a push element is slidingly arranged and actuated by a helical spring, said push element having two mutually parallel lateral surfaces and being controlled by two dual-position guide mechanisms wherein each of the dual-position guide mechanisms is disposed on one lateral surface of the push element and including a cam groove guide and an S-pin, wherein each one of cam groove guides is arranged on one lateral side of the push element, and each of the S-pins is pivotally arranged within a recess of the lateral wall of the groove of the housing, wherein one leg of the S-pin is in a hole in said recess and the second leg of the S-pin extends into the interior of the groove of the housing and into the cam groove guide of the push element.

7. Touch-latch device according to claim 6, wherein said push element is provided at a free end with a regulation plug displaceable in an axial direction by an arrester arranged therein.

8. Touch-latch device according to claim 6, wherein the arrester is arranged in a through hole of a threaded extension of the push element and the regulation plug.

9. Touch-latch device according to claim 8, wherein each S-pin is arranged within the hole in a way that the legs of both S-pins perpendicular thereto lie in a same plane that coincides with an axial plane of the device in an idle mode.

10. A touch-latch device used in furniture especially for initial opening of an opening furniture component, such as drawers or doors, without handles, comprising a housing with an axially arranged groove, in which groove a push element is slidingly arranged and actuated by a helical spring and controllable by two dual-position guide mechanisms including a cam groove guide and an S-pin, wherein each cam groove guide of each of the two dual-position guide mechanisms is arranged on each lateral side of the push element and each S-pin is pivoted in each of the lateral walls of the groove of the housing, and the push element being provided at a free end with a regulation plug arranged by a bolted joint, said plug being displaceable in an axial direction, wherein the axial displacement of the regulation plug is limited by an arrester arranged therein, the arrester being a double-sided riveted bolt of a predetermined length arranged in a through hole of a threaded extension and the regulation plug.

* * * * *